United States Patent [19]

Niemann

[11] 3,997,079

[45] Dec. 14, 1976

[54] AUTOMATIC INFLATING DEVICE FOR LIFESAVING DEVICES

[76] Inventor: Wolfgang Niemann, Im Rehwinkel 4b, 2105 Seevetal 3, Germany

[22] Filed: Apr. 16, 1975

[21] Appl. No.: 568,429

[30] Foreign Application Priority Data

Apr. 17, 1974 Germany ..... 7413311[U]

[52] U.S. Cl. ..... 222/5; 9/318

[51] Int. Cl.[2] ..... B67B 7/24

[58] Field of Search ..... 9/316–320; 222/3, 5

[56] References Cited

UNITED STATES PATENTS

| | | | |
|---|---|---|---|
| 1,329,990 | 2/1920 | Müller | 9/318 |
| 2,894,658 | 7/1959 | Spidy | 9/317 |
| 3,242,514 | 3/1966 | Waters | 9/318 |
| 3,494,506 | 2/1970 | Fujimoto | 222/5 |

*Primary Examiner*—Trygve M. Blix
*Assistant Examiner*—Stuart M. Goldstein
*Attorney, Agent, or Firm*—Walter Becker

[57] ABSTRACT

A self-inflating device for lifesaving equipment, in which the lifesaving equipment automatically inflates itself as soon as a piercing member forming part of the device is projected by a spring-urged shank into a closure diaphragm of a compressed air containing vessel. The spring-urged shank pertaining to a first housing section is prevented from hitting the piercing member by a preferably annular member arranged in a second housing member disengageably connected to the first housing member, as long as the device is not in the water but as soon as the device is in the water, the preferably annular member disintegrates and thereby permits the shank under the influence of the spring acting thereon to cause the piercing member to pierce the closure diaphragm for the compressed air containing vessel which then dispenses its content into the lifesaving equipment to be inflated. To ready the device for a new self-inflation, it is merely necessary to disengage the second housing section from the first housing section to allow a spring associated with the piercing member to lift the latter to its starting position, to replace the ring member and to connect a new pressure medium containing vessel and to again connect the first housing section to the second housing section.

9 Claims, 5 Drawing Figures

AUTOMATIC INFLATING DEVICE FOR LIFESAVING DEVICES

The present invention relates to an automatic inflating device for floating for floatable lifesaving devices, which becomes effective when acted upon by water and which comprises a striker for piercing a closure diaphragm of a pressure gas cartridge, and in which in a initiating device a spring-urged shank is by the influence of water released to move the striker toward the closure diaphragm. The spring was arrested in cocked position by means of a ring that loses its strength in the water and disintegrates.

With an inflating device of this type as it has become known, the releasing device consists primarily of a shank which is arranged in a housing and is surrounded by a spring bringing about the movement of the striker, said shank having fork-shaped ends held together by the ring which loses its strength in water. In said shank between th fork-shaped ends and said ring there is arranged a transverse latch which keeps the spring in loaded condition. Following the automatic release of this device, it is necessary, in order to again ready the device for action, to replace in addition to the pressure gas cartridge also the release device comprising shank, spring, transverse latch and ring. Such replacement is time-consuming and expensive.

It is, therefore, an object of the present invention to provide an automatic inflating device for floatable lifetsaving device, which after the automatic release can in a simple and inexpensive manner again be readied for new operation.

These and other objects and advantages of the invention will appear more clearly from the following specification in connection with the accompanying drawings, in which.

Figure 1:
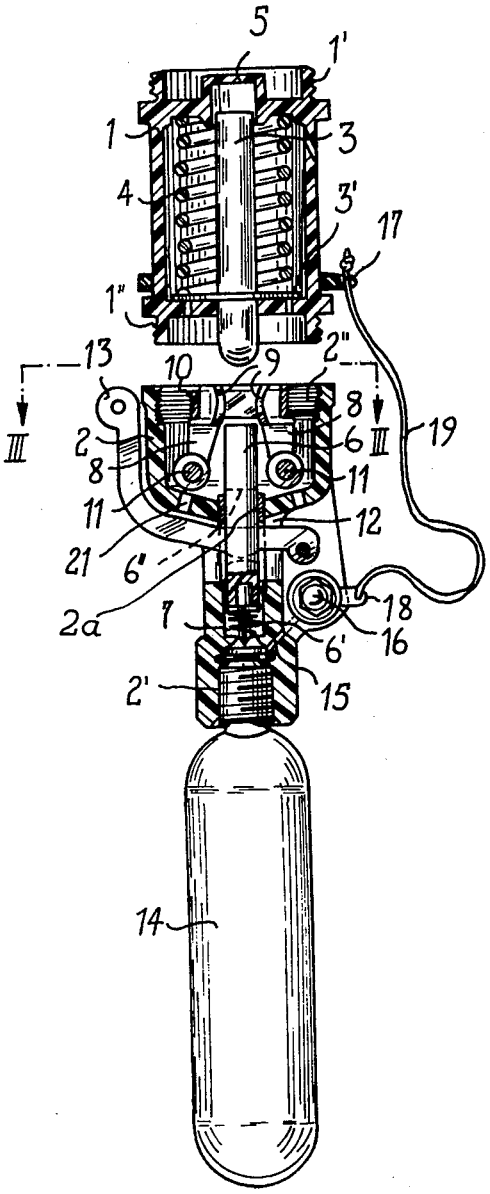
FIG. 1 illustrates a longitudinal section through an automatic inflating device according to the invention with the upper portion of said housing being removed.

The device according to the present invention is characterized primarily in that the release device is arranged in a two-sectional housing having a lower section which carries the pressure gas cartridge and in which there is provided the arresting device for the spring, said arresting device comprising at least two blocking levers held together by the ring. The said housing also comprises a sleeve-shaped upper section which is adapted to be screwed into said lower section and in which the spring and the shank are provided.

When screwing the upper section which the spring and the shank are not detachably arranged, into the lower section of the housing, one end of the shank is pressed against the blocking levers which are held together by the ring, whereby the automatic release device according to the invention is cocked or tensioned. If now the ring is surrounded by water, it loses its strength whereby the blocking levers due to the forces acting thereupon are moved apart so that the cocked spring no longer encounters resistance and the shank can act upon the striker whereby the closure diaphragm of the pressure gas cartridge is destroyed.

In order to be able to return this automatic release device again in a position ready for action, it is merely necessary to disengage the upper section from the lower section of the housing whereby the blocking levers which are now no longer subjected to forces are accessible so that a new ring holding said levers together can be arranged thereon. Expediently, the blocking levers are rotatably arranged on the wall of the lower section.

After the housing sections have been screwed together and the used up pressure gas cartridge has been replaced by a new one, the device according to the present invention is again ready for action.

According to a preferred embodiment of the invention, the upper section of the housing is at oppositely located ends provided with a threaded portion adapted to be screwed into said lower section. As a result thereof, for storing the device or when using the device on lifesaving equipment, the automatic inflation of which is undesirable on certain occassions, the automatic system can be made ineffective by screwing the upper section onto the lower section in such a way that the shank does not act upon the blocking levers.

For purposes of manually releasing the inflating device according to the invention, there is provided a manual release lever which is guided in a longitudinal slot of the striker and is linked to the lower section of the housing while said lever has its free end projecting from the housing. The free end of the manually operably lever may expediently engage the outside of the housing while the spring is loaded. The guiding of the manual release lever in a longitudinal slot of the piercing pin furthermore brings about the advantage that the position of the free end of this lever indicates the condition of operation of the inflating device.

Referring now to the drawings in detail, the inflating device according to the invention illustrated therein comprises a two-sectional housing the lower section 2 of which has an axial bore 2*a*. Guided within this bore 2*a* is a striker 6 provided with a piercing or penetrating needle 6′. Each of the two axial ends of the lower section 2 is provided with an inner thread 2′ and 2″ respectively into which there is screwed a pressure gas cartridge 14 and the upper section 1 of the housing (FIG. 2). The needle 6′ is directed toward the pressure gas cartridge 14. Pivotally mounted on pins 11 on the inner wall of that end of the lower section 2 which is remote from the pressure gas cartridge 14 are blocking levers 8. The blocking levers 8 have their free ends provided with arched surfaces 9 which point toward the axis of the housing. Furthermore, within the region of the surfaces 9, a ring 10 surrounds blocking levers 8 and loses its strength when it comes into contact with water. The ring 10 holds the blocking levers 8 in their FIGS. 1 and 2 positions. In the longitudinal slots 6″ and 12 of the striker 6 and the lower section 2 there is guided a manually operable release lever 13 which is linked to the lower section 2. This lever 13 has its free end in engagement with the outside of the housing when the release device is in a position ready for action.

In order to be sure that this happens, that end of the striker 6 which carries the piercing or penetrating needle 6′ is under the influence of a return spring 7 which presses the striker 6 away from the pressure gas cartridge 14.

The upper section of housing which is adapted to be screwed into the inner thread 2'' of the lower section 2 comprises a sleeve the ends of which are respectively provided with an outer thread 1' and 1'' fitting into the inner thread 2''. One end of the sleeve is closed by a cap 5 in which a shank 3 is guided. Between the cap 5 and washer 3' connected to shank 3' connected to shank 3 there is clamped-in under load a spring 4. That end of shank 3 which is remote from cap 5 is rounded and when screwing together the upper section 1 and the lower section 2 presses against the arched surfaces 9 of the blocking levers 8. Inasmuch a ring 10 prevents a pivoting movement of the blocking levers 8 in the direction toward the wall of the lower section 2, shank 3 is against the thrust of spring 4 adjusted from its FIG. 1 position to its FIG. 2 position. If the inflating device which in FIG. 2 occupies its position ready for action, and which may be connected for instance to the collar of a life jacket is immersed in an emergency in the water, water passes through bores 21 in the lower section 2 into the interior of the latter whereby ring 10 is surrounded by water and loses its strength. Spring 4 can then press the rounded end of shank 3 past the blocking levers 8 against the striker 6 whereby the piercing needle 6 pierces and destroys the closure diaphragm of the pressure gas cartridge 14. The gas stored in said pressure gas cartridge 14 then flows through a passage 15 and a check valve 16 into the lifesaving device to be inflated (not illustrated).

Figure 2:
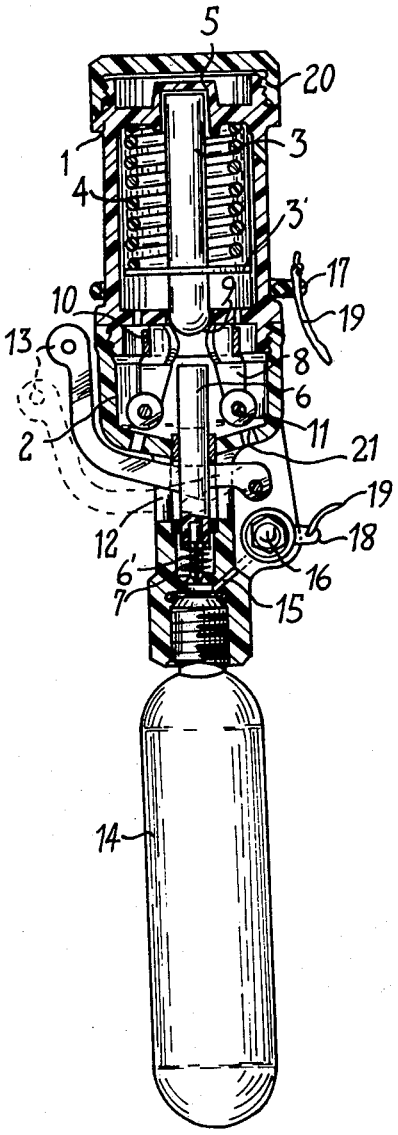
FIG. 2 is a longitudinal section similar to that of FIG. 1 with the upper portion of the housing screwed thereon.
Figure 3:
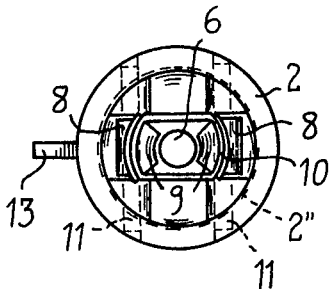
FIG. 3 is a plan view of the lower portion of the inflating device according to FIG. 1, along line III—III thereof.
Figure 4:
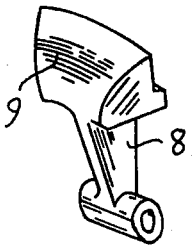
FIG. 4 is a perspective illustration of a blocking lever on an enlarged scale.
Figure 5:
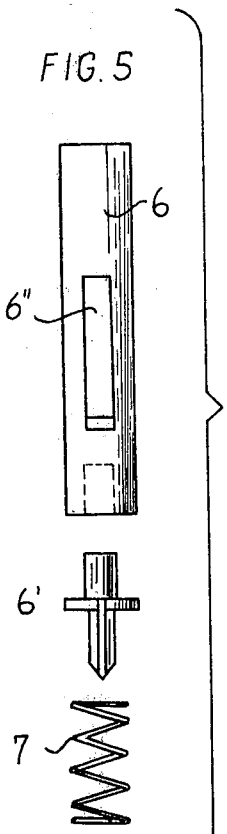
FIG. 5 is an explosive view of the striker with a return spring, likewise on an enlarged scale.

In the above described automatically initiated condition of the inflating device, the penetrating needle 6' has entered the pressure gas cartridge 14 and has displaced the striker 6 accordingly whereby the manual release lever 13 is pivoted into the position shown in FIG. 1 by dash lines. As a result thereof, the free end of the manually operable release lever 13 has been removed from the wall of the lower section 2 and thus indicates the condition of operation of the inflating device.

In order to be able to return the thus released inflating device to its condition of operation, the upper section 1 is screwed off the lower section 2, and a new ring 10 is placed upon the blocking levers 8. The return spring 7 returns the striker 6 with the piercing needle 6' and the manually releaseable lever 13 to its starting position so that a filled pressure gas cartridge 14 can be screwed into the inner thread 2' without the danger that its closure diaphragm may be damaged. After the upper section 1 has been screwed onto the lower section 2, the inflating device is again ready for operation.

The inflating device according to the invention may, of course, also be manually released. To this end, the lever 13 is adjusted by means of a force acting upon its free end.

If it is desired to make the automatic release of the inflating device ineffective, it is merely necessary to screw off the upper section 1 from the lower section 2 (FIG. 1). A release of the inflating device by hand by actuating the manually operable release lever 13 is also assured in this instance. In order to prevent the loss of the upper section, said lower section may, with the cap 5 directed toward the lower section 2, be screwed into said lower section 2. To this end, the upper section 1 and the lower section 2 may additionally be interconnected by a cord 19 the ends of which are fastened in an eye 18 on the lower section 2 or on a slide ring 17 on the upper section 1.

Furthermore, a cover 20 is while extending above the cap 5 screwed onto the thread 1' whereby these parts of hollow chamber is formed in which a ring can be inserted for replacement purposes. Ring 10 may be of any suitable material which quickly disintegrates in water. In this connection, paper has proved very satisfactory for the purpose of the invention.

It is, of course, to be understood that the present invention is, by no means, limited to the specific showing in the drawings but also comprises any modifications within the scope of the appended claims.

What is claim is:

1. An automatic inflating device for floating lifesaving devices, which includes housing means comprising a first section and a second section adapted to be threadedly connected to each other, said second having an axial bore, striking means including piercing means and being reciprocably arranged in said axial bore of said second housing means section and being movable from a non-piercing position to a piercing position and vice versa, said second housing means section adjacent said piercing means for comprising means for detachably connecting thereto a compressed gas containing cartridge with a closure diaphragm adapted to be pierced by said piercing means in said piercing position, a shank provided and reciprocably guided in said first housing means section in the axial direction thereof, spring washer means connected to said shank, spring means arranged around said shank between said spring washer means and that end portion of that first housing means section which is remote from said second housing means section, said spring means in non-piercing position of said striking means being tensioned to continuously urge said shank in the direction toward said striking means into said piercing position, lever means pivotally journalled in said second housing means section, and holding means adapted to disintegrate in water and in non-piercing position of said striking means holding said lever means partially between said shank and said striking means for preventing said shank from moving said piercing means into said piercing position.

2. A device according to claim 1, in which said lever means are pivotally supported by wall portions of said second housing means section.

3. A device according to claim 1, in which those sections of said first and second housing means sections which in assembled condition of said device are adjacent to each other are respectively provided with interfitting thread for threaded engagement with each other.

4. A device according to claim 1, in which said striking means includes a shank with a longitudinal slot, and in which a manually operable lever has one end portion pivotally connected to said second section of said housing means and extends through said slot and has its other end portion representing its free end portion projecting from said slot for manual actuation.

5. A device according to claim 4, in which said free end portion of said manually operable lever is so shaped as to engage the outside of said second housing means section when said spring means is tensioned and said striking means is in its non-piercing position.

6. A device according to claim 1, which includes means for non-detachably interconnecting said first and second housing means sections.

7. A device according to claim 1, in which said shank and said striking means are in axial alignment with each other.

8. A device according to claim 1, which includes a return spring associated with said piercing means for returning same to its non-piercing position following a piercing action thereof.

9. A device according to claim 1, in which said holding means consists of paper.

* * * * *